United States Patent [19]

Ioffe et al.

[11] 4,077,027

[45] Feb. 28, 1978

[54] METHOD OF ORIENTED FEEDING OF NONMAGNETIC CURRENT-CONDUCTING COMPONENTS AND DEVICES FOR EFFECTING SAME

[76] Inventors: Benyamin Alexandrovich Ioffe, ulitsa Stirnu 37a, kv. 44; Robert Karlovich Kalnin, ulitsa Gorkogo 53, kv. 19; Jury Arvidovich Zommer, ulitsa Artilerias 52, kv. 25; Yanis Ekabovich Graubin, prospekt Mezha, 10, kv. 2; Eduard Prokofievich Davydenko, ulitsa Ierikju, 29, kv. 40; Ivan Ivanovich Kern, ulitsa Auglju, 4, kv. 1, all of Riga, U.S.S.R.

[21] Appl. No.: 759,993

[22] Filed: Jan. 17, 1977

[51] Int. Cl.[2] ..... H01F 7/10

[52] U.S. Cl. ..... 335/219; 335/250; 335/284

[58] Field of Search ..... 335/219, 243, 250, 282, 335/284, 299

[56] References Cited

U.S. PATENT DOCUMENTS

| | | | |
|---|---|---|---|
| 3,651,439 | 3/1972 | Ioffe et al. | 335/219 |
| 3,662,302 | 5/1972 | Ioffe et al. | 335/219 |

*Primary Examiner*—George Harris

*Attorney, Agent, or Firm*—Lackenbach, Lilling & Siegel

[57] ABSTRACT

A method of oriented feeding of nonmagnetic current-conducting components is proposed, wherein an alternating magnetic field is set up, whose induction vector is normal to the desired direction of feeding. Components are introduced into this field, one by one, and at least one closed current-conducting loop is secured in the magnetic field so that its plane is normal to the induction vector of the field and offset with respect to the geometrical center of the component introduced into the field in the direction of feeding. Oriented feeding is effected under the action of electrodynamic forces induced by the alternating magnetic field as a result of the interaction of the overlapping current circuits induced by the magnetic field in the components and in the current-conducting closed loop. The device for carrying out the proposed method comprises a source of an alternating magnetic field and a sectional plate arranged in the working area of this field, each plate section including an electric coil. The device is also provided with a control panel including a set of contacts corresponding in number to and arranged in the same manner as the plate sections. Each coil has one of its terminals connected to a respective control panel contact, and the other coil terminal is grounded.

16 Claims, 20 Drawing Figures

FIG.12
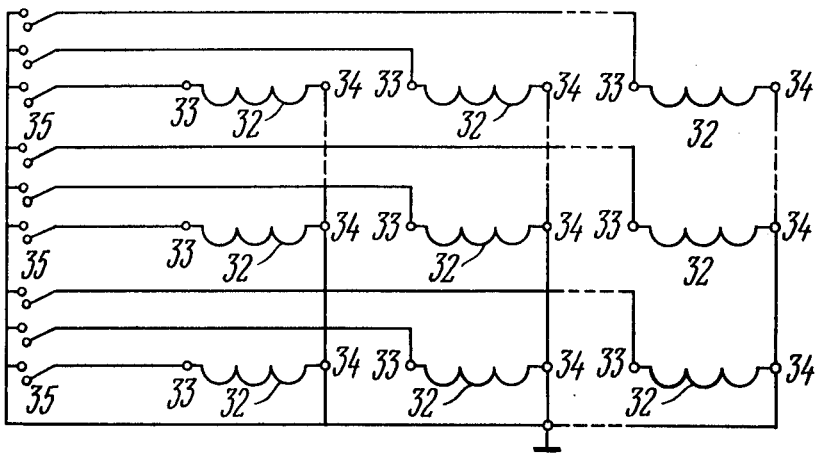
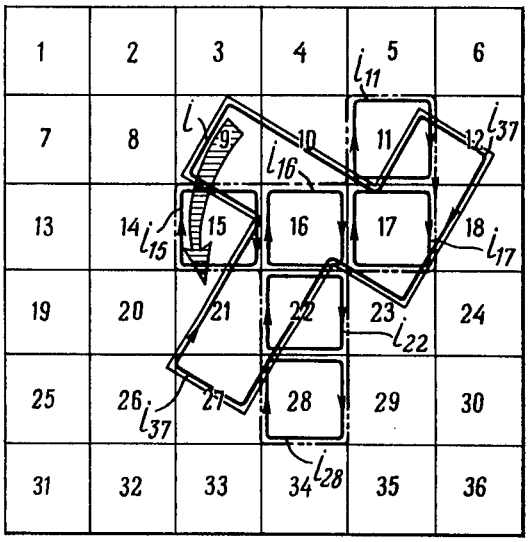
FIG.13

METHOD OF ORIENTED FEEDING OF NONMAGNETIC CURRENT-CONDUCTING COMPONENTS AND DEVICES FOR EFFECTING SAME

The present invention relates to automation of manufacturing processes, and more particularly to methods of oriented feeding of nonmagnetic current-conducting components and devices for effecting same.

The invention can be most advantageously used for automatic loading of processing equipment, treatment and assembly of individual units, and active checking and sorting of asymmetrical nonmagnetic current-conducting components dissimilar in shape and in size. The invention can also be used for setting nonmagnetic current-conducting components in the required position on a base surface so they can be delivered further along the processing line.

There is known a method of splitting asymmetrical nonmagnetic current-conducting components into oriented flows. In accordance with this method, the splitting into flows is effected in a symmetrical alternating magnetic field with a gradiant directed towards the center (line) of symmetry. The latter is attained by narrowing the pole gap of the electromagnet towards the center of symmetry.

However, in this method, the pole gap widening outwards from the center of symmetry results in a higher reluctance and, consequently, an increased power consumption. In addition, this results in a lower intensity of the currents induced in the end portions of the components, and hence, in weaker forces acting thereupon. For the same reason, a substantial portion of the pole gap with a high electromagnetic energy density is not utilized.

Besides, this prior art method is suitable for oriented feeding of only asymmetrical nonmagnetic current-conducting components since the components are divided into oriented flows in symmetrical magnetic fields.

Another method is known according to which oriented feeding of nomagnetic current-conducting components is effected in the process of their assembly under the action of electromagnetic forces appearing in an alternating magnetic field as a result of the interaction of the overlapping current circuits induced in the components being assembled by the magnetic field.

This method permits oriented feeding of components only along the assembly axis and towards one another till their mating surfaces come into contact.

It is an object of the present invention to provide a method of oriented feeding of symmetrical, from the point of view of electric conduction, nonmagnetic current-conducting components in any direction.

Another object of the invention is to provide a method of oriented feeding of asymmetrical nonmagnetic current-conducting components in any direction.

Still another object of the invention is to provide a method of oriented feeding of nonmagnetic current-conducting components in a continuous flow as well as singly.

Yet another object of the invention is to provide a method of oriented feeding of nonmagnetic current-conducting components over a base surface, securing them on this surface and subsequent changing of their position therein.

A further object of the invention is to provide a remotely controlled device for oriented feeding of nonmagnetic current-conducting components in a desired direction.

These objects are attained by a method of oriented feeding of nonmagnetic current-conducting components under the action of the electrodynamic forces appearing in an alternating magnetic field as a result of the interaction of the overlapping current circuits induced by the magnetic field, the induction vector of the magnetic field, according to the invention, being normal to the desired direction of feeding, components being introduced into this magnetic field and at least one closed current-conducting loop being secured therein, and the plane of the loop being normal to the induction vector of the magnetic field and offset with respect to the geometrical center of the component introduced into the magnetic field in the desired direction of feeding.

It is expedient to place two closed current-conducting loops in the magnetic field, symmetrical to each other, on either side of the component.

For oriented feeding of asymmetrical nonmagnetic current-conducting components, additional loops should preferably be provided in the magnetic field, equal in number to the main current-conducting loops, identical therewith, and arranged symmetrically thereto relative to the plane passing through the geometrical center of the component introduced into the magnetic field and parallel to the induction vector of the magnetic field.

The configuration of the loops should preferably be similar to that of the current circuit induced in the component by the magnetic field.

In this case, the loops should preferably be made to oscillate in their plane.

The objects of the invention are also attained by a device for oriented feeding of nonmagnetic current-conducting components by the proposed method, which comprises a source of an alternating magnetic field, a sectional plate arranged in its working area according to the invention, each plate section including an electric coil, and a control panel including a set of contacts corresponding in number to and arranged in the same manner as the plate sections, each coil having one of its terminals connected to a respective contact of the panel and the other coil terminal grounded.

It is desirable to provide the control panel with a templet having a configuration similar to that of the current circuit induced in the components being fed by the magnetic field.

In the case where a C-electromagnet is used as the source of the alternating magnetic field, the device should preferably be provided with an additional sectional plate similar to the main one, the plates being arranged opposite each other at the poles of the C-electromagnet.

The sectional plate may be made multilayered, all layers being similar and each subsequent layer being shifted with respect to the preceding one by half the coil's length along one of the axes X, Y of the plane in which the components are fed. In this case, the turns, of the coils in the subsequent layers should preferably intertwine with those of the coils in the preceding layers, and the coils should be connected to the control panel contacts through switches so that when the contacts of the switches of the coils in one layer are connected, those of the switches of the coils in the other layers are opened.

The method of oriented feeding of nonmagnetic current-conducting components, in accordance with the present invention, permits non-contact transfer of any, symmetrical or asymmetrical, nonmagnetic current-conducting components in any direction. The method is particularly advantageous for oriented feeding of components in a continuous flow, although it can also be used for oriented feeding of single nonmagnetic current-conducting components.

The herein proposed embodiments of devices for carrying out the method of oriented feeding of components are built of conventional elements widely used in electrical engineering, are highly reliable and do not require any particular skill in handling them.

The invention will now be described in greater detail with reference to specific embodiments thereof, taken in conjunction with the accompanying drawings, wherein:

FIG. 12 is an electric circuit diagram showing the coil connections;

FIG. 13 shows the working surface of a sectional plate;

Figure 1:
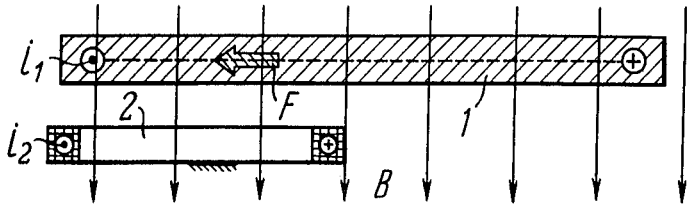
FIG. 1 is a cross-sectional view of a nonmagnetic current-conducting component and a current-conducting loop in a magnetic field.

The proposed method of oriented feeding of nonmagnetic current-conducting components will now be considered with reference to FIG. 1 which is a cross-sectional view of a flat nonmagnetic current-conducting component 1 and a closed current-conducting loop 2 introduced into a magnetic field with an induction vector B.

The method of the present invention resides in that an alternating magnetic field is set up, whose induction vector B is normal to the desired direction of feeding. Introduced into this magnetic field, in any appropriate manner, is the component 1 and the closed current-conducting loop 2 the latter being secured in the magnetic field, upon introduction thereinto, so that its plane is normal to the induction vector B and offset with respect to the geometrical center of the component 1, in the desired direction of feeding. Current $i_1$ is induced in the component 1 by the magnetic field, and current $i_2$ is induced in the closed loop 2. Overlapping of the circuits of the currents $i_1$ and $i_2$ gives rise to electrodynamic forces, under the action of which the circuits of the currents $i_1$ and $i_2$ tend to coincide or to become symmetrical relative to each other (equilibrium state). Since the closed loop 2 is rigidly fixed in the magnetic field, the component 1 acted upon by the electrodynamic force F, shown in FIG. 1 by an arrow, starts moving in the direction indicated by the arrow (desired direction of feeding). In this case, the induction of the magnetic field is selected sufficient to create a force F accelerating the component 1 so that the latter passes through the equilibrium position and, overcoming the force F acting thereupon in the opposite direction, leaves the magnetic field.

The force F acting upon the component in the desired direction of feeding increases if two identical closed current-conducting loops are placed in the magnetic field symmetrically to each other on either side of the component.

Figure 2:
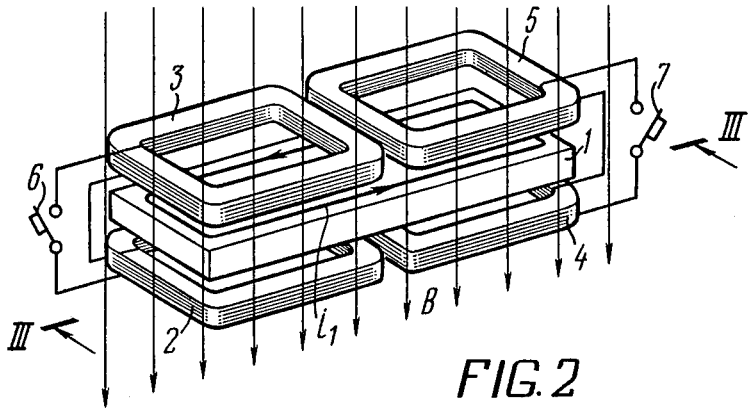
FIG. 2 is an isometric view of a nonmagnetic current-conducting component and four current-conducting loops in a magnetic field.

FIG. 2 is an isometric view of the nonmagnetic current-conducting component 1 with two pairs of current-conducting loops 2, 3 and 4, 5. The loops 2 and 3 are arranged symmetrically to each other on either side of the component 1 and offset with respect to its geometrical center in one direction, while the loops 4 and 5 are also arranged symmetrically to each other on either side of the component 1 and offset relative to its geometrical center in the opposite direction. The loops 2 and 3 are electrically connected in series and are provided with a switch 6. The loops 4 and 5 are also connected in series and are provided with a switch 7.

Figure 3:
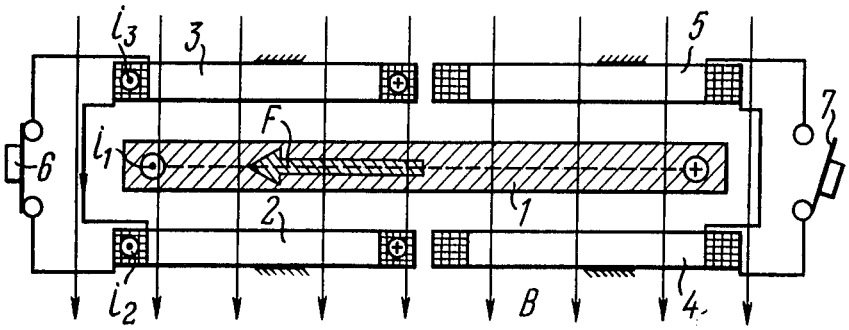
FIG. 3 is a cross-sectional view taken along the line III—III of FIG. 2 with two loops being connected into a circuit.

FIG. 3 which is a section view taken along line III—III of FIG. 2 illustrates the case where the contacts of the switch 6 are closed and currents $i_2$ and $i_3$ are induced in the loops 2 and 3, which currents interact with the current $i_1$ induced in the component 1. As a result of this interaction, there appears an electrodynamic force F acting upon the component 1 and moving it in the direction indicated by an arrow in FIG. 3 (to the left).

Figure 4:
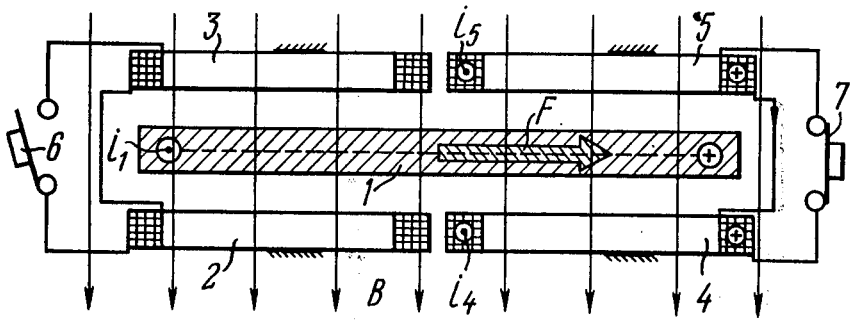
FIG. 4 is a cross-sectional view taken along the line III—III of FIG. 2 with the other two loops being connected into a circuit.

In contrast with FIG. 3, shown in FIG. 4 is the case where the contacts of the switch 6 are open, hence, the loops 2 and 3 are disconnected, while the contacts of the switch 7 are closed and induced in the loops 4 and 5 are currents $i_4$ and $i_5$ interacting with the current $i_1$ induced in the component 1. In this case, there appears an electrodynamic force F which moves the component 1 in a direction opposite to that indicated in FIG. 3 (to the right, as shown in FIG. 4).

Figure 5:
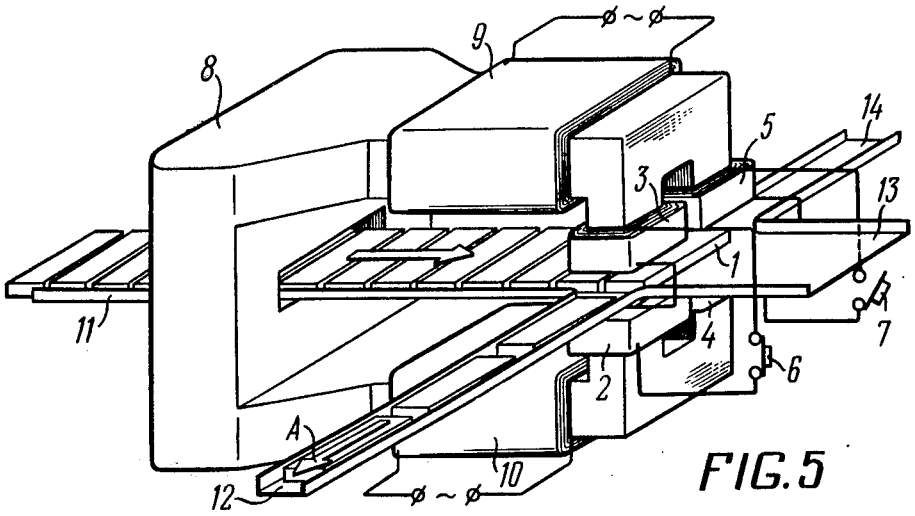
FIG. 5 is an isometric view of a device for oriented feeding of components in one of three possible directions, according to the invention.

FIG. 5 shows an embodiment of the proposed device for oriented feeding of a flow of components in one of three possible directions.

The device comprises a C-electromagnet 8 with field coils 9 and 10 connected to an a-c source (not shown). The poles of the electromagnet 8 are split with the loops 2, 3 and 4, 5 provided with the switches 6 and 7, respectively, being slippted thereover. The device also has a vibration tray 11 for feeding components 1 into the working area of the magnetic field of the electromagnet 8, as well as trays 12, 13 and 14 for delivering the components 1 away from the magnetic field. The trays 12 and 14 are set at a right angle to the vibration tray 11, and the tray 13 is an extension of the tray 11.

In order to deliver the components 1 to the tray 12, the loops 2 and 3 are connected (shorted) by the switch 6. The currents induced in the component 1 are in the pole gap and interact with those induced in the loop 2 and 3 with the result that the component 1 is forced out with a certain speed into the tray 12, in the direction indicated by arrow A in FIG. 5. Then, the components which have been thrown into the tray 12 (or 13, or 14) are conveyed further by any conventional means, e.g. by vibration.

Accordingly, to direct the components 1 into the tray 14, the contacts of the switch 6 are opened, will those of the switch 7 are connected, and the components 1 start being forced out into the tray 14.

When it is necessary to deliver the components 1 to the tray 13, the contacts of both switches 6 and 7 may be either closed or open. In this case, no change in the direction of feeding of the components 1 will take place. Evidently, one may simply de-energize the magnetic field, which is far more rational.

The essence of the proposed method, as well as the embodiment of the proposed device under consideration, is described with reference to the case where only two pairs of loops 2, 3 and 4, 5 are involved, which permits distributing components in three directions only. It is eivident that the number of loop pairs (and, consequently, the number of sections in the sectional poles, as shown in FIG. 5) can be substantially increased, if necessary, whereby the number of possible directions (number of delivery trays) in which components may be conveyed can be increased as well.

So far, there have been considered cases or oriented feeding of symmetrical nonmagnetic current-conducting components.

The proposed method also permits oriented feeding of asymmetrical nonmagnetic current-conducting components.

This feature of the invention will be considered with reference to a bimetallic flat component. As is well known, a bimetallic component may serve as an electrodynamic analogue of an asymmetrical component, since the presence of holes, threads, slots, etc. in a component results in lower equivalent electric conduction thereof, therefore, a bimetallic analogue may be regarded as a general case of such a component. It is to be understood that the proposed method can be used for oriented feeding of asymmetrical components of any shape, and a flat component is considered herein merely for simplicity.

Figure 6:
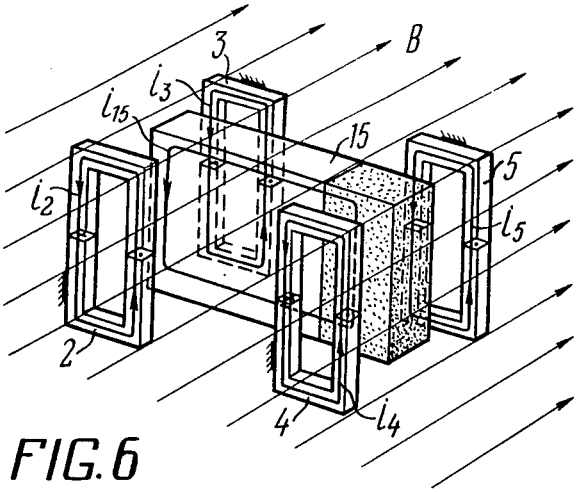
FIG. 6 is an isometric view of an asymmetrical nonmagnetic current-conducting component and four closed loops in a magnetic field.

According to the invention, an asymmetrical nonmagnetic current-conducting component 15 (FIG. 6) is introduced into an alternating magnetic field, the induction vector B of which being is normal to the desired direction of feeding of this component. Also introduced into and rigidly fixed in the same magnetic field are four closed current-conducting loops 2, 3, 4 and 5. The loops 2, 3, 4 and 5 are arranged relative to the component 15 in the same manner as was shown in FIG. 2, with the difference that the paired loops 2, 3 and 4, 5 must be arranged symmetrically with respect to the plane passing through the geometrical center of the component 15 and parallel to the induction vector B of the magnetic field. Currents $i_2$, $i_3$, $i_4$, $i_5$ and $i_{15}$, practically coinciding in phase, are induced in the loops 2, 3, 4, 5 and component 15, respectively. It is well known that currents flowing in the same direction are attracted to one another, while oppositely directed currents are repulsed from one another. Or, put in other words, parallel turns with currents flowing therethrough in the same direction are attracted to one another, while those wherethrough currents flow in opposite directions are repulsed from one another. In the case of coincidence of the phase angles, all currents, as shown in FIG. 6, flow in the same direction at any moment. Even in the case of slight dephasing, it can be said that the currents $i_2$, $i_3$, $i_4$, $i_5$ and $i_{15}$, averaged for any half-cycle, flow in the same direction. Therefore, the circuits of these currents are always attracted to one another. Since the loops 2, 3,4 and 5 are rigidly fixed, only the component 15 can move. It should be noted that conventional means can be used to ensure complete coincidence in phase of the currents induced in the loops and component. For example, a circuit including an inductance and a capacitor connected in series may serve as such means. As a result of the conduction of the material of the component 15 varying throughout its length, the circuit of the current $i_{15}$ is always biased to some extent towards the end of the component 15 with better conduction. Since, as is known, the attraction between two circuits varies inversely with the square of the distance therebetween, the circuit of the current $i_{15}$, positioned as shown in FIG. 6, is attracted to a greater extent to the circuits of the currents $i_2$ and $i_3$, and the component 15 moves rapidly towards the circuits of the currents $i_2$ and $i_3$, provided the induction of the magnetic field is of an appropriate magnitude, and as it is accelerated, the component 15 passes through the equilibrium position and is practically thrown beyond the working area of the magnetic field.

Figure 7:
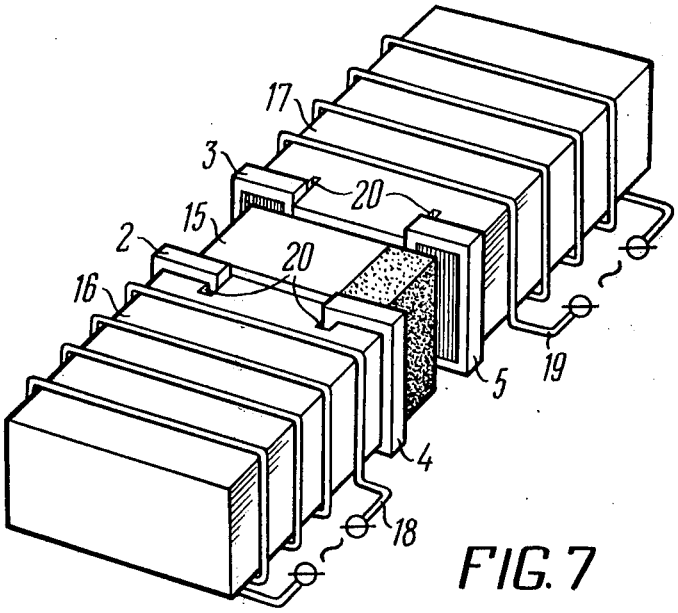
FIG. 7 is an isometric view of an embodiment of the device for oriented feeding of nonmagnetic current-conducting components, according to the invention.

Shown in FIG. 7 is an embodiment of the device for oriented feeding of asymmetrical nonmagnetic current-conducting components.

The device comprises an electromagnet with flat poles 16 and 17 with coils 18 and 19 connected to an a-c source (not shown).

The closed loops 2, 3, 4 and 5 are secured in slots 20 made in the poles 16 and 17. Such an arrangement permits the pole gap, and hence, energy losses, to be minimized. A component 15 is introduced into the pole gap.

The device shown in FIG. 7 operates on the principle described with reference to FIG. 6.

In the case of a flat thin component, the closed current-conducting loops can be arranged only on one of the flat poles. In the case of a thicker component, these loops should preferably be arranged on both poles 16 and 17. The most efficient magnetic fields are those with radial symmetry, which can be attained, at least partially, by using cylindrical poles with loops symmetrically arranged along the periphery of such poles. Such magnetic fields can be set up on the pole gaps of C-electromagnets and in electromagnets of other shapes.

In the case where the configuration of the closed loops is similar to that of the current circuit induced in the asymmetrical component by the magnetic field, the flow of asymmetrical nonmagnetic current-conducting components may be conveyed in the desired direction, the components being oriented in the flow as required by the element of asymmetry.

Figure 8:
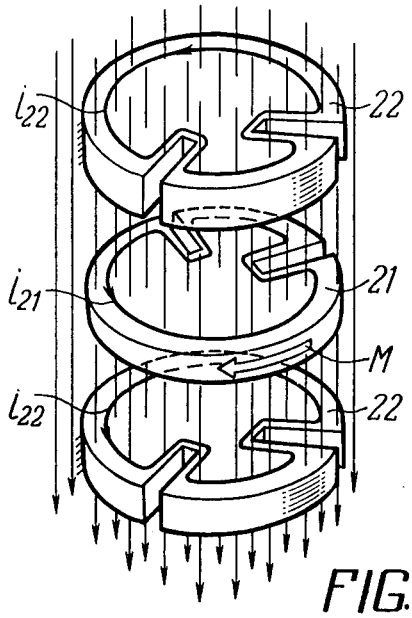
FIG. 8 is an isometric view of an asymmetrical nonmagnetic current-conducting component and two templets in a magnetic field.

Consider now an embodiment of the invention with a flat component 21 (FIG. 8) approaching in shape a body of rotation and having two asymmetrical slots.

The component 21 is introduced into the magnetic field between two closed current-conducting loops, in this case templets 22 secured in the magnetic field. The configuration of each templet 22 is similar to that of the component 21, and they are arranged coaxially so that the slots therein are aligned in a vertical plane. In the alternating magnetic field whose induction vector B is normal to the planes of the templets 22 and component 21, currents $i_{21}$ and $i_{22}$ are induced in the component 21 and templets 22, respectively, the interaction of their magnetic fields giving rise to forces turning the component 21. When the circuits of the currents $i_{21}$ and $i_{22}$ fully concide (i.e. the elements of asymmetry of the component 21 and templets 22 are aligned in a vertical plane), the turning moment M becomes equal to zero, and the attained position is properly oriented and stabilized.

If each of the templets 22 is provided with coils having switches, the asymmetrical nonmagnetic current-conducting component oriented as described above may be removed from the working area of the magnetic field in the desired direction.

Figure 9:
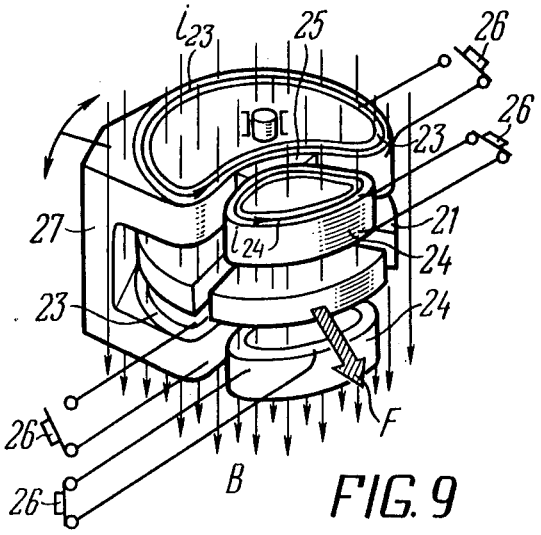
FIG. 9 is an isometric view of a templet.

FIG. 9 is an isometric view of a possible embodiment of the templets for oriented feeding of a component 21, each being provided with two coils 23 and 24 rigidly interconnected by means of a connector 25. Each one of the coils 23 and 24 has its own switch 26. The shape of each coil 23 and 24 is selected such that the circuits of currents $i_{23}$ and $i_{24}$ induced therein by the magnetic field have a configuration similar to that of the current circuit induced in the component 21. The templets are secured on a common base 27.

The above-described device operates as follows. The templets are placed between the poles of an electromagnet (i.e. a C-electromagnet, not shown) so that they can oscillate in their plane. In this case, the oscillation amplitude is selected so as to provide for overlapping of the current circuits induced in the templets and component 21. Such oscillations are intended to accelerate the process of orienting the components A magnetic field is then set up, the induction vector B whereof being normal to the templets plane. The contacts of all the switches 26 are closed, and a component 21 is introduced into the space between the templets. As this takes place, the component 21 is oriented by the elements of asymmetry, as described above. Thereafter, the coils 23, for example, are de-energized by opening the switches 26. Therewith, the component 21 is acted upon by the force F indicated in FIG. 9 by a large arrow and, oriented by the elements of asymmetry, is moved in the direction indicated by the arrow towards a receiver (not shown).

The coils 23 being energized and the coils 24 de-energized, the component 21 is pushed out of the pole gap in a direction opposite to that indicated by the arrow in FIG. 9.

Figure 10:
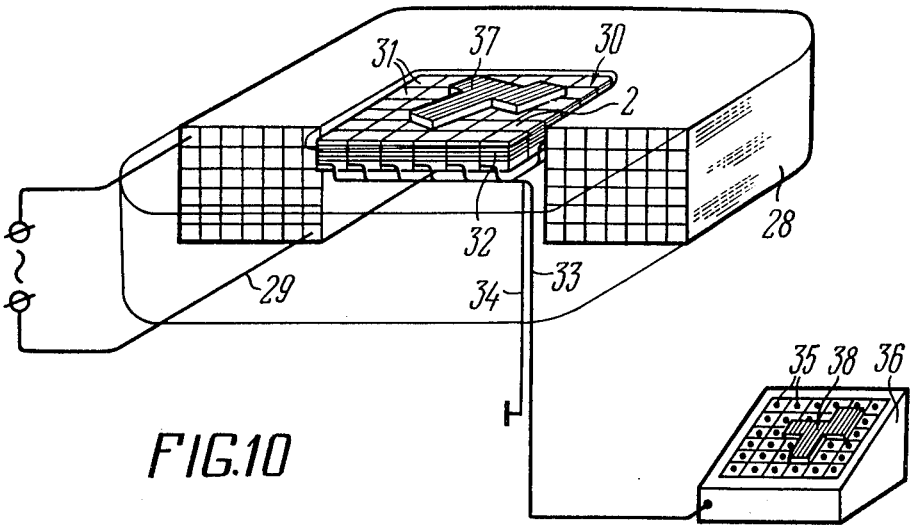
FIG. 10 is an isometric view of a device for oriented feeding of flat asymmetrical nonmagnetic current-conducting components on a surface, according to the invention.

FIG. 10 is an isometric view of a device for oriented feeding of flat nonmagnetic current-conducting components and for securing them on the surface on which they are conveyed.

This device comprises and alternating magnetic field source made as a solenoid 28 with a winding 29 connected to an a-c source (not shown). Placed in the magnetic field of the solenoid 28 is a sectional plate 30, each section 31 whereof accommodating a separate electric coil 32 with terminals 33 and 34. Each terminal 33 of the coils 32 is connected to a respective contact 35 of a control panel 36, and the terminals 34 are interconnected and grounded. The control panel 36 is essentially a set of contacts 35 corresponding in number to and arranged in the same manner as the sections 31 of the plate 30. Shown in FIG. 10, on the surface of the plate 31, is the component 37 being oriented, and the control panel 36 is provided with a templet 38 to facilitate programming the contacts 35, the shape of the templet 38 being similar to that of the component 37.

Figure 11:
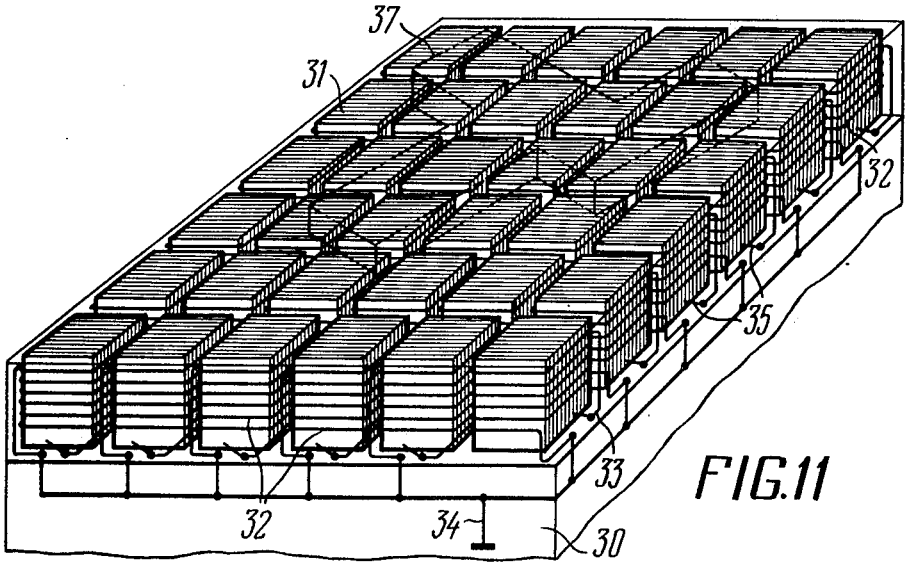
FIG. 11 is an isometric view of a sectional plate, according to the invention.

FIG. 11 is an enlarged isometric view of the sectional plate 30 with the coils 32, the component 37 being shown by a dash line.

FIG. 12 is an electric circuit diagram showing the connection of the coils 32 to the respective contacts 35 of the control panel.

In FIG. 13, the numbered squares conventionally indicate the working surface of the sectional plate, the component being oriented being shown by a solid line and the desired position of the component on the plate being shown by a dash line. This drawing is intended to illustrate the principle of oriented feeding of a nonmagnetic current-conducting component on a surface.

The device represented in FIGS. 10, 11, 12 and 13 operates in the following fashion.

A component 37 is delivered onto the sectional plate 30 in any appropriate way, whereafter, to secure it in a fixed position, the templet 38 is positioned as required on the control panel 36 to energize, by pressing respective contacts 35, respective coils 32 of the sectional plate 30. In this case, currents $i_{15}$, $i_{16}$, $i_{11}$, $i_{17}$, $i_{22}$ and $i_{28}$, respectively, are induced in the energized coils 32 (the circuits of these currents are shown by a dash line in FIG. 13). In addition, current $i_{37}$ is induced in the component; no current flows through the open coils 32. As is well known, the circuits of the currents flowing in the same direction are attracted, while those of the currents flowing in opposite directions are repulsed, hence, owing to the differential interaction between individual current circuits in the sectional plate 30 and parts of the circuit of the current $i_{37}$ induced in the component, the component is acted upon by forces turning it to the required position (the direction of these forces is indicated by a large arrow in FIG. 13). As the circuits of the currents $i_{15}$, $i_{16}$, $i_{11}$, $i_{17}$, $i_{22}$ and $i_{28}$ induced in the coils 32 coincide with the circuit of the current $i_{37}$ induced in the component, the integrated moment acting upon the component 37 becomes equal to zero, and the component 37 is set to the required position.

Figure 14:
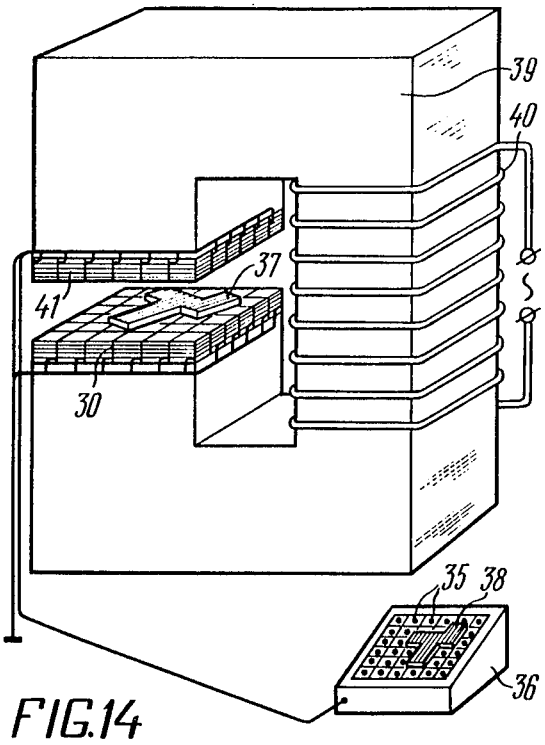
FIG. 14 is a perspective view of a device for oriented feeding of flat components on a surface, including two sectional plates, according to the invention.

To enhance the forces acting upon the components being oriented, a device is proposed, shown in FIG. 14, in which the magnetic field source is made as a C-electromagnet 39 with a winding 40, and, in addition to the main sectional plate 30 made on one of the pole faces of the electromagnet 39, there is provided another sectional plate 41 on the other pole, similar to the main one and also having separate coils. In this case, the templet 38 on the control panel 36 energizes both respective upper and lower coils, the principle of operation of the device remaining the same.

Figure 15:
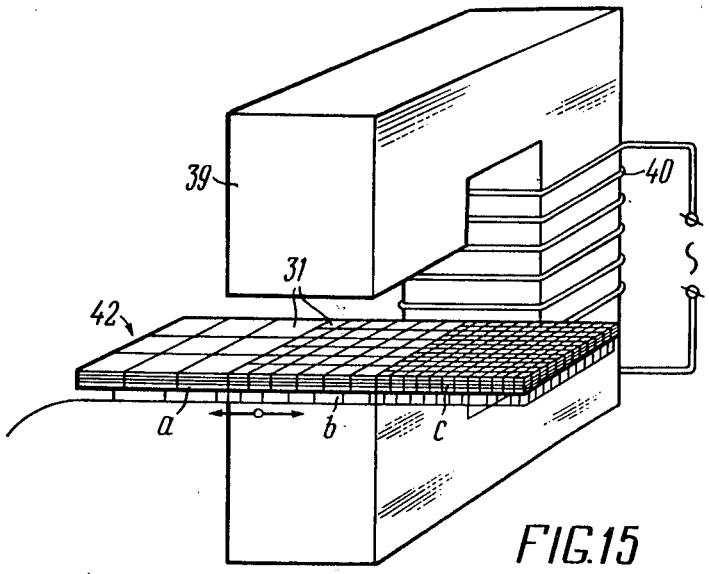
FIG. 15 is a perspective view of a device for oriented feeding of flat components on a surface; including a movable sectional plate, according to the invention.

The embodiment illustrated in FIG. 15 is intended for feeding and securing on a surface components of different sizes, and, in contrast to the device of FIG. 14, it has a sectional plate 42 divided into three portions "*a*", "*b*" and "*c*" following one another and differing in the number and size of the sections 31. The portion "*a*" with the least number of sections is intended for oriented feeding of larger components, while the section "*c*" with the greatest number of sections is intended for accurate positioning of smaller components, the portion "*b*" being used for intermediate sizes. The plate 42 is mounted on a pole face of the electromagnet 39 and adapted to reciprocate thereon for the portions "*a*", "*b*" and "*c*" to alternate.

Figure 16:
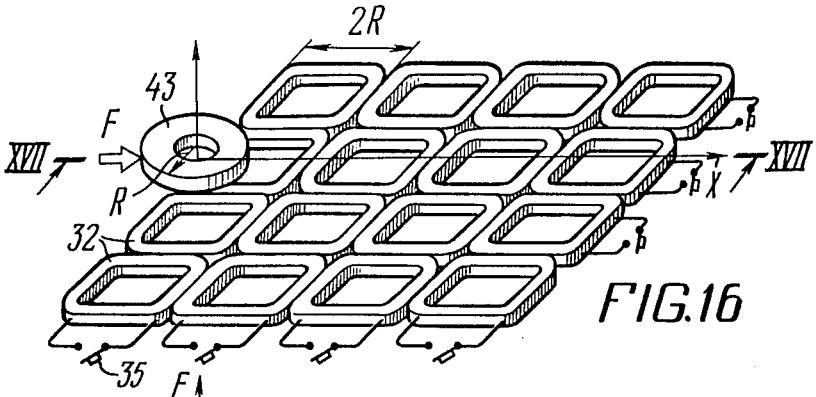
FIG. 16 is an isometric view of a portion of a single-layer sectional plate.

FIG. 16 is an isometric view of a portion of a single-layer sectional plate including coils 32, the length of each coil being equal to twice the radius R of an annular component 43. The terminals of each coil 32 are connected to respective contacts 35 of the control panel so that it can be energized or de-energized whenever necessary. When this sectional plate with the component 43 placed thereon is introduced into the alternating magnetic field whose induction vector is normal to the plate's plane, the component 43 is acted upon by force F.

Figure 17:
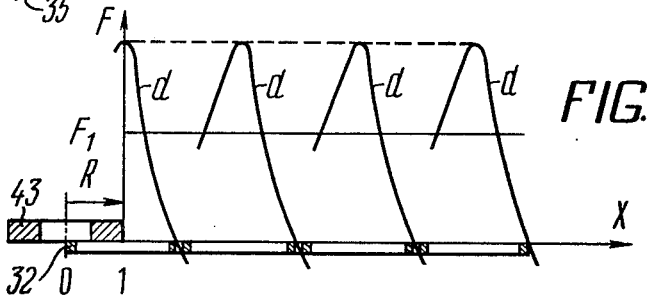
FIG. 17 is a graph showing the variation of the force F as a component moves on the surface of the plate of FIG. 16 along axis X.

Curves "*d*" in FIG. 17 show the variation in the force F when the component 43 moves on the plate along the axis X. Also shown on the axis X are the cross sections of the sectional plate and the component 43, illustrated in FIG. 16. $F_1$ is the mean value of the electrodynamic force acting upon the component 43 as it moves on the plate surface along the axis X. As can be inferred from FIG. 17, as soon as the component 43 is aligned with the coil 32, F = 0. This means that in such a case the position of the component 43 can be controlled only when the radius of the component exceeds half the length of the coil 32.

Figure 18:
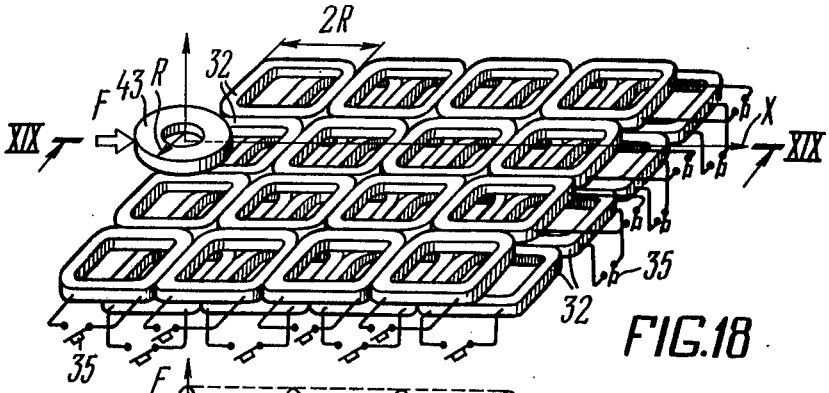
FIG. 18 is an isometric view of a portion of a two-layer sectional plate.

FIG. 18 is an isometric view of a portion of a two-layer sectional plate. The first layer includes coils 32 and is similar to the sectional plate of FIG. 16. The other layer is similar to the first one, includes the same number of coils 32, is arranged directly above the first layer, but is shifted relative thereto along the axis X by half the length of a coil 32.

Figure 19:
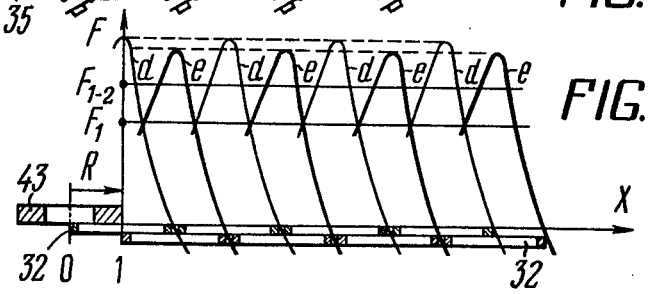
FIG. 19 is a graph showing the variation of the force F as a component moves on the surface of the plate of FIG. 18 along axis X.

Curves "*d*" and "*e*" in FIG. 19 show the variation in the force F acting upon the component 43 as it moves on the surface of the two-layer plate along the axis X. Also shown on the axis X are the cross sections of the two-layer plate and the component 43 illustrated in FIG. 18. $F_{1\text{-}2}$ is the mean value of the electrodynamic force acting upon the component 43 as it moves on the plate along the axis X. For comparison, FIG. 19 also shows the mean value $F_1$ of the electrodynamic force acting upon the component as it moves on a single-layer plate.

As can be seen in FIG. 18, the multilayer sectional plate supporting the component 43 having been introduced into the alternating magnetic field, the component 43 is acted upon by the force F as a result of the coil 32 of the first layer being energized. When the coil 32 of the first layer is de-energized and that of the second layer is energized, the component 43 is subjected to the action of a maximum force along the axis X (FIG. 19).

When the coil 32 of the second layer is de-energized and that of the first layer is energized, the component 43 moving along the axis X is again acted upon by a maximum force, and so on. It can be seen from FIGS. 18 and 19 that a two-layer sectional plate permits active control of components equal in size to or smaller than the circuit of the current through the coils 32, whereby the efficiency of such devices is improved. Besides, such a sectional plate substantially increases the mean value of the electrodynamic force F acting upon the component being controlled. The graph of FIG. 19 indicates that $F_{1\text{-}2}$ exceeds $F_1$ by almost 30%.

By making the sectional plate three-layered so that the third layer is shifted by a value R relative to the first two layers along the axis Y, the efficiency of the device can be likewise improved over the entire surface of the sectional plate.

Figure 20:
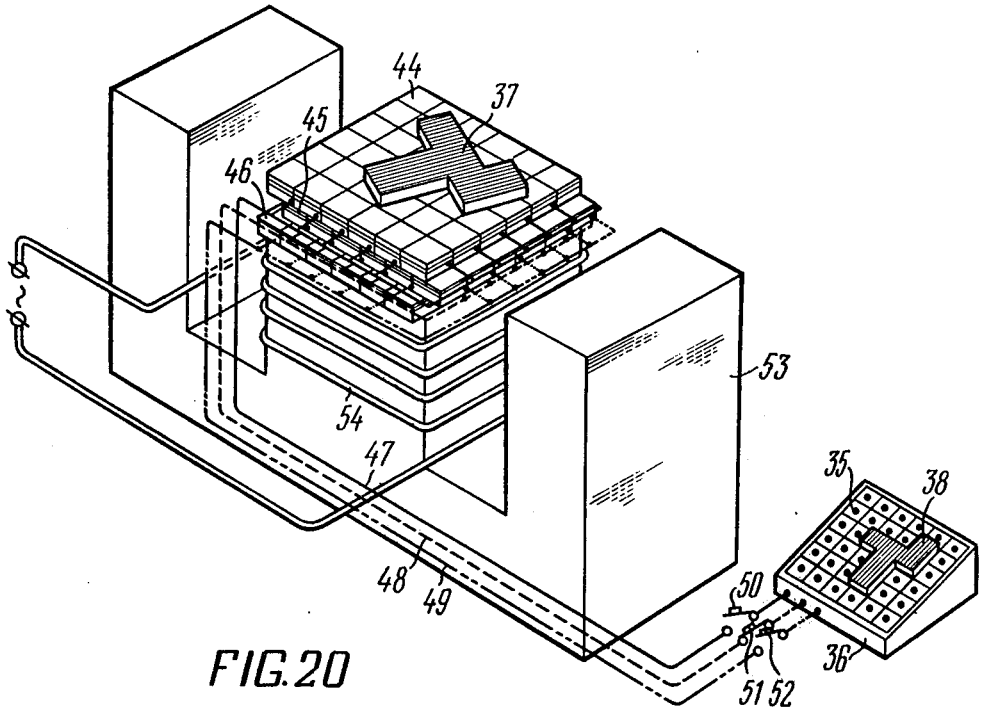
FIG. 20 is an isometric view of a device with a three-layer sectional plate, according to the invention.

FIG. 20 shows a device with a sectional plate consisting of three layers 44, 45 and 46 shifted relative to one another by half the length of a coil, i.e. by R, the layer 45 being shifted along the axis X and the layer 46 along the axis Y. The terminals of the coils are connected to the control panel 36 by means of cables 47, 48 and 49. Each of these cables is connected to the control panel 36 through switches 50, 51 and 52, respectively.

The three-layer sectional plate is mounted on a pole of an E-shaped electromagnet 53 with a field winding 54 connected to an a-c source (not shown).

The device of FIG. 20 operates as follows.

A component 37 is delivered onto the surface of the three-layer sectional plate, and the templet 38 on the control panel 36 is positioned similarly to the component 37 on the plate. The field winding 54 is energized, and the operator moves the templet 38 on the contact surface of the control panel 36 towards the position corresponding to the required position of the component. Therewith, depending on the direction in which the templet 38 is moved, the operator manipulates keys 50 to 52 to alternately connect one of the layers 44, 45 and 46 to the contacts 35 of the control panel 36 so that when the coils of the layer 45 are energized (as shown in FIG. 20), those of the layers 44 and 46 are de-energized.

Figure 21:
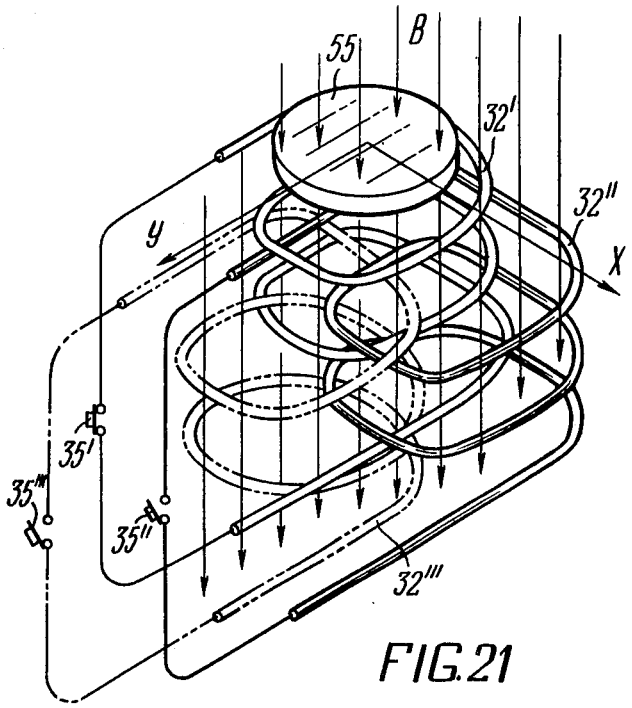
FIG. 21 is an isometric view of a portion of the three-layer sectional plate.

To bring the coils of all the layers of the sectional plate as close as possible to the component in order to maintain equality of the force interaction between the latter and each individual coil in different layers, the turns of the subsequent coils are intertwined with those of the coils of the preceding layers. A portion of such a three-layer is illustrated in FIG. 21. On such a plate, a component 55 directly interacts with the coil 32' of the first layer and recedes from the coil 32'' of the second layer and the coil 32''' of the third layer only by a distance practically equal to the thickness of the wire of the coil 32', which is approximately 0.2–0.5 mm. FIG. 21 shows the mutual position of individual coils 32', 32'' and 32''', each being provided with its own switch 35' 35'' and 35''', respectively. Their contacts are arranged on the control panel (not shown).

The other coils of the sectional plate are arranged similarly as shown in FIG. 21, i.e. the turns of the coils 32'' are shifted relative to those of the coils 32' along the axis X by half the coil's length, and the turns of the coils 32''' are shifted relative to those of the coils 32' and 32'' along the axis Y.

For illustrative purposes, the spacing between the turns is slightly exaggerated. Actually, this spacing is equal to twice the wire's diameter.

The space between the turns is filled with a ferrite compound, whereby a solid sectional plate is formed.

Such devices look promising for non-contact positioning of components, including steel blanks heated to a temperature above the Curie point the process of thermal treatment.

What is claimed is:

1. A method of oriented feeding of nonmagnetic current-conducting components, comprising the steps of: setting up an alternating magnetic field whose induction vector is normal to a desired direction of feeding; introducing a component into said magnetic field; securing at least one closed current-conducting loop in said magnetic field so that its plane is normal to the induction vector of said magnetic field and is offset with respect to the geometrical center of said component in the desired direction of feeding; and effecting said oriented feeding under the action of electrodynamic forces appearing in said alternating magnetic field as a result of an interaction of overlapping current circuits induced by said magnetic field in said component and in said closed current-conducting loop.

2. A method as claimed in claim 1, wherein two closed current-conducting loops are placed in said magnetic field, symmetrically to each other, on either side of said component.

3. A method as claimed in claim 1, further including the step of providing additional closed current-conducting loops in said magnetic field, said additional loops being equal in number to the current-conducting loops, being identical therewith, and arranged symmetrically thereto with respect to the plane passing through the geometrical center of said component and parallel to the induction vector of said magnetic field.

4. A method as claimed in claim 2, further including the step of providing additional closed current-conducting loops in said magnetic field, said additional loops being equal in number to the current-conducting loops, being identical therewith, and arranged symmetrically thereto with respect to the plane passing through the geometrical center of said component and parallel to the induction vector of said magnetic field.

5. A method as claimed in claim 1, wherein the configuration of said loops is similar to that of the current circuit induced in said component by said magnetic field.

6. A method as claimed in claim 2, wherein the configuration of said loops is similar to that of the current circuit induced in said component by said magnetic field.

7. A method as claimed in claim 1, further including the step of oscillating said loops in their plane.

8. A method as claimed in claim 2, further including the step of oscillating said loops in their plane.

9. A device for oriented feeding of nonmagnetic current-conducting components, comprising: a source of an alternating magnetic field; a main sectional plate arranged in a working area of said magnetic field, so that its plane is normal to an induction vector of said magnetic field, and having sections; electric coils, equal in number to said sections arranged one per said section so that their axes of rotation are parallel to said induction vector of said magnetic field, each of said coils having a first terminal and a second terminal; and a control panel having contacts, equal in number to said coils arranged in the same manner as said plate sections, said first terminals of said coils being connected to respective contacts of said control panel and said second terminals being grounded.

10. A device as claimed in claim 9, wherein said control panel is provided with a templet having a configuration similar to that of a current circuit induced in said components being fed by said magnetic field.

11. A device as claimed in claim 9, comprising: a C-electromagnet serving as said magnetic field source; an additional sectional plate similar to the main plate, said main and additional sectional plates being arranged one opposite the other on the poles of said electromagnet.

12. A device as claimed in claim 10, comprising: a C-electromagnet serving as said magnet field source; an additional sectional plate similar to the main one; said sectional plates being arranged one opposite the other on the poles of said electromagnet.

13. A device as claimed in claim 9, wherein said sectional plate is multilayered, all layers being similar and each subsequent layer being shifted with respect to the preceding one by half the length of said coil along one of the axes X, Y of the plane in which said components are fed.

14. A device as claimed in claim 13, wherein the turns of said coils in the subsequent layers intertwine with those of said coils in the preceding layers.

15. A device as claimed in claim 13, wherein said coils are connected to said contacts of said control panel through switches so that when the contacts of said switches of said coils in one layer are connected, those of said switches of said coils in the other layers are opened.

16. A device as claimed in claim 14, wherein said coils are connected to said contacts of said control panel through switches so that when the contacts of said switches of said coils in one layer are connected, those of said switches of said coils in the other layers are opened.

* * * * *